US011383900B2

(12) United States Patent
Gift et al.

(10) Patent No.: US 11,383,900 B2
(45) Date of Patent: Jul. 12, 2022

(54) PEDIATRIC DOSING DISPENSER

(71) Applicant: Berry Global, Inc., Evansville, IN (US)

(72) Inventors: Steven Gift, Lititz, PA (US); Michael M. Makhlouf, Lititz, PA (US); Jacob B. Robison, Marietta, PA (US); Brian Martin, New Providence, PA (US); John A. Vassallo, Lititz, PA (US)

(73) Assignee: Berry Global, Inc., Evansville, IN (US)

( * ) Notice: Subject to any disclaimer, the term of this patent is extended or adjusted under 35 U.S.C. 154(b) by 105 days.

(21) Appl. No.: 16/806,284

(22) Filed: Mar. 2, 2020

(65) Prior Publication Data

US 2020/0277112 A1 Sep. 3, 2020

Related U.S. Application Data

(60) Provisional application No. 62/818,899, filed on Mar. 15, 2019, provisional application No. 62/812,512, filed on Mar. 1, 2019.

(51) Int. Cl.

| | |
|---|---|
| ***B65D 50/06*** | (2006.01) |
| ***B65D 47/18*** | (2006.01) |
| ***B65D 47/24*** | (2006.01) |
| ***B65D 47/08*** | (2006.01) |

(52) U.S. Cl.

CPC ..... *B65D 50/066* (2013.01); *B65D 47/08* (2013.01); *B65D 47/18* (2013.01); *B65D 47/241* (2013.01); *B65D 2215/04* (2013.01); *B65D 2547/063* (2013.01)

(58) Field of Classification Search

CPC ..... B65D 50/066; B65D 50/06; B65D 47/08; B65D 47/06; B65D 47/18; B65D 47/241

USPC ..... 220/281, 260, 270, 266, 265, 833, 810, 220/367.1; 215/237, 235, 254, 253, 250, 215/216, 201, 311, 307; 251/366

See application file for complete search history.

(56) References Cited

U.S. PATENT DOCUMENTS

| | | | | |
|---|---|---|---|---|
| 3,853,157 A | | 12/1974 | Madaio | |
| 4,493,348 A | | 1/1985 | Lemmons | |
| 4,940,167 A | * | 7/1990 | Fillmore | B65D 50/045 222/153.09 |
| 5,314,084 A | | 5/1994 | Folta | |
| 5,573,516 A | | 11/1996 | Tyner | |
| 5,620,434 A | | 4/1997 | Brony | |

(Continued)

FOREIGN PATENT DOCUMENTS

| | | |
|---|---|---|
| EP | 1424292 A1 | 6/2004 |
| GB | 2513840 | 11/2014 |

(Continued)

OTHER PUBLICATIONS

International (PCT) Search Report and Written Opinion for PCT/US2020020654 dated May 6, 2020, BP-542 PCT, 10 pages.

(Continued)

*Primary Examiner* — Robert J Hicks

(74) *Attorney, Agent, or Firm* — Barnes & Thornburg LLP

(57) ABSTRACT

A package is configured to store and dispense fluids. The package includes a container and a dosing dispenser for closing an opening formed in the container. The dosing dispenser includes a lid having a syringe receiver, a child-resistant closure-release mechanism, and a valve assembly configured to permit the flow of fluid from the container to the syringe.

19 Claims, 9 Drawing Sheets

(56) References Cited

U.S. PATENT DOCUMENTS

| | | | | |
|---|---|---|---|---|
| 5,911,252 | A | 6/1999 | Cassel | |
| 6,065,648 | A | 5/2000 | Tauber | |
| 6,405,885 | B1 * | 6/2002 | Elliott | B65D 47/0838 215/237 |
| 7,077,176 | B2 | 7/2006 | Py | |
| 7,404,495 | B2 * | 7/2008 | Keung | B65D 47/0804 215/216 |
| 8,459,312 | B2 | 6/2013 | Manera | |
| 10,058,481 | B1 | 8/2018 | Russo | |
| 11,242,185 | B2 | 2/2022 | Marantis | |
| 2006/0186077 | A1 | 8/2006 | Robinson | |
| 2007/0214692 | A1 | 9/2007 | Ferrara | |
| 2008/0237278 | A1 | 10/2008 | Gaus | |
| 2010/0327010 | A1 | 12/2010 | Manera | |
| 2011/0168292 | A1 | 7/2011 | Luzbetak | |
| 2012/0103468 | A1 | 5/2012 | Terwilliger | |
| 2012/0103469 | A1 | 5/2012 | Terwilliger | |
| 2012/0103470 | A1 | 5/2012 | Terwilliger | |
| 2012/0104054 | A1 | 5/2012 | Terwilliger | |
| 2012/0211505 | A1 | 8/2012 | Vollers | |
| 2013/0102989 | A1 | 4/2013 | McCoy | |
| 2013/0160891 | A1 * | 6/2013 | Vassallo | B65D 47/0804 141/27 |
| 2013/0180618 | A1 | 7/2013 | Py | |
| 2014/0261860 | A1 | 9/2014 | Heath | |
| 2015/0112296 | A1 | 4/2015 | Ishiwata | |
| 2015/0209230 | A1 | 7/2015 | Lev | |
| 2016/0130049 | A1 | 5/2016 | Rogers | |
| 2018/0098913 | A1 | 4/2018 | Vassallo | |
| 2018/0207061 | A1 | 7/2018 | Fox | |

FOREIGN PATENT DOCUMENTS

| | | | |
|---|---|---|---|
| GB | 2513840 | A | 11/2014 |
| WO | 2007027567 | | 3/2007 |
| WO | 2008065879 | A1 | 6/2008 |
| WO | 2009133754 | A1 | 11/2009 |
| WO | 2018122019 | | 7/2018 |
| WO | 2019090079 | A1 | 5/2019 |

OTHER PUBLICATIONS

International (PCT) Search Report and Written Opinion for PCT/US2020/020659 dated May 7, 2020, BP-544 PCT, 10 pages.

International (PCT) Search Report and Written Opinion for PCT/US2020/020650 dated May 7, 2020, BP-540 PCT, 16 pages.

Office Action (Non-Final Rejection) dated Feb. 18, 2022 for U.S. Appl. No. 16/806,462, BP-542 US-U (pp. 1-9).

* cited by examiner

PEDIATRIC DOSING DISPENSER

PRIORITY CLAIM

This application claims priority under 35 U.S.C. § 119(e) to U.S. Provisional Application No. 62/818,899, filed Mar. 15, 2019, and U.S. Provisional Application Ser. No. 62/812,512, filed Mar. 1, 2019, both of which are expressly incorporated by reference herein.

BACKGROUND

The present disclosure relates to dosing dispensers for mounting on the top of bottles, or other containers, and in particular, to a dosing dispenser including a body portion coupled to a container and a flip-top cap coupled to the body portion. More particularly, the present disclosure relates to a dosing dispenser with a syringe receiver.

SUMMARY

According to the present disclosure, a closure includes a lid and a flip-top cap mounted to the lid. The lid includes a top wall formed to include an opening and a side wall that extends downwardly from the top wall and extends circumferentially about a central axis. The flip-top cap is mounted to the lid for pivotable movement about a cap pivot axis relative to the lid between a closed position and an opened position.

In illustrative embodiments, the closure further includes a child-resistant closure-release mechanism including a lock tab coupled to the flip-top cap to move therewith and first and second retainer rails coupled to the outer side wall of the lid in a fixed position relative to the flip-top cap. The lock tab is deformable relative to the lid from a locked position to an unlocked position. In the locked position, the lock tab engages the first and second retainer rails to block the flip-top cap from pivoting about the cap pivot axis to the opened position. In the unlocked position, at least a portion of the lock tab is deformed inwardly toward the inner side wall of the lid to disengage the lock tab from the first and second retainer rails.

In illustrative embodiments, the closure further includes a valve including a central port, an upper disk, and a lower disk. The central port is sized and arranged to extend through the central aperture formed in the top wall. The upper disk is coupled to the central port and arranged against an inner surface of the top wall. The lower disk is coupled to a lower surface of the upper disk. The central port and the upper disk are formed to include a first passageway that extends along the central axis. The lower disk is formed to include a second passageway that extends along a second axis that is transverse to the central axis.

In illustrative embodiments, the closure further includes an anti-suction feature coupled to the top wall of the lid and configured to maintain spacing between an upper surface of the top wall and a mouth of a person placed on the lid around the opening. The anti-suction feature minimizes formation of a complete seal between the mouth and the lid so that the person cannot establish sufficient suction to remove fluid through the opening.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
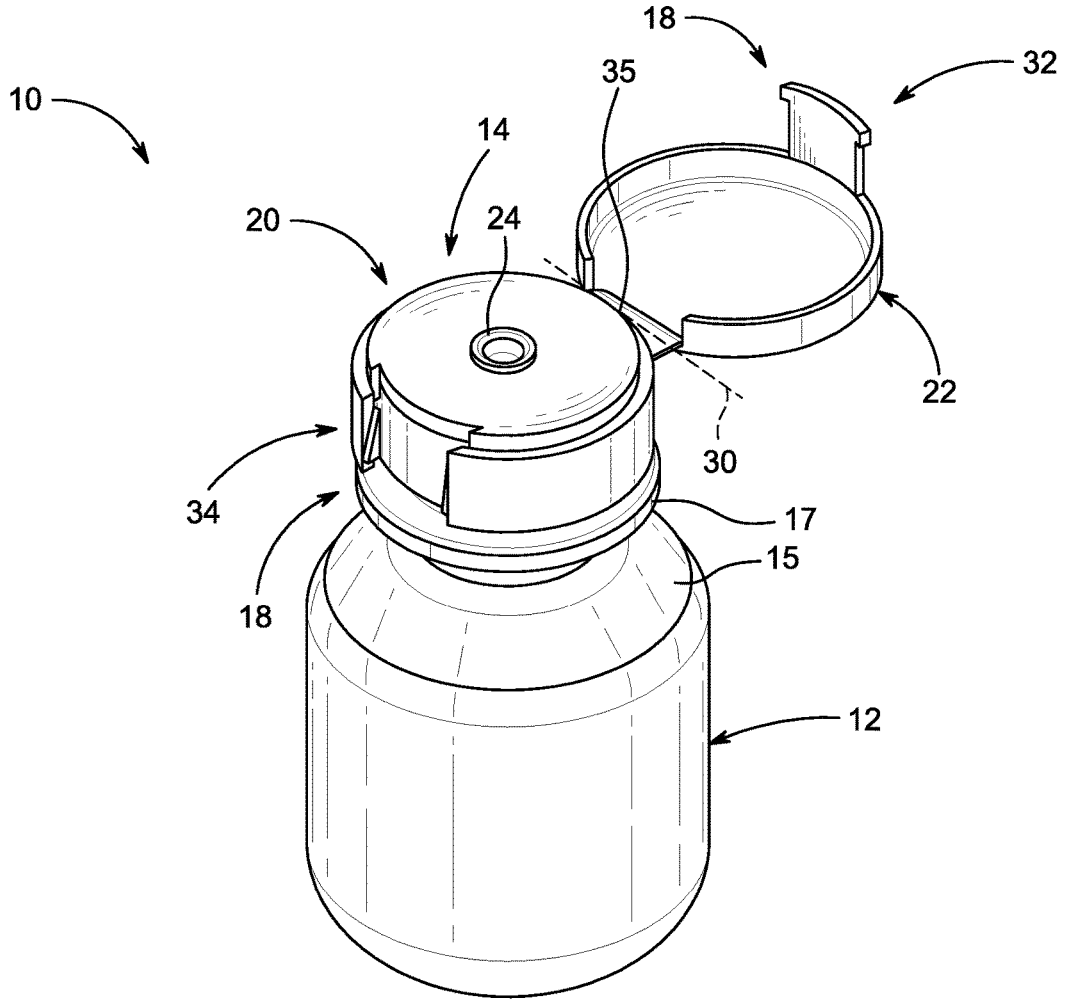
FIG. 1 is a perspective view of a package showing that the package includes a container and a dosing dispenser, the dosing dispenser including a lid having a top wall and a side wall, a flip-top cap mounted to the lid for pivotable movement about a cap pivot axis between a closed position and an open position, and a child-resistant closure-release mechanism including a lock tab coupled to the flip-top cap and first and second retainer rails coupled to an outer side wall of the lid such that the lock tab may engage the rails to block the flip-top cap from opening and disengage the rails to allow the flip-top cap to open.

A package 10 in accordance with the present disclosure includes a container 12, a dosing dispenser 14 (also referred to as a closure) coupled to a filler neck 16 of the container 12, and a child-resistant closure-release mechanism 18 as shown, for example, in FIG. 1. The dosing dispenser 14 includes a lid 20 adapted to be coupled to the container 12 and includes a flip-top cap 22 that is pivotably coupled to lid 20 to conceal a syringe receiver 24. The syringe receiver 24 is configured to accept a fluid-transfer tip of a syringe (not shown) to permit the dosing of liquid from the container 12, as suggested in FIG. 1. The syringe receiver 24 may be configured as a one-way valve so as to block flow of fluid through the syringe receiver 24 absent insertion of a fluid-transfer tip of a syringe. The syringe receiver 24 may also include a valve assembly 200, 300, as will be discussed in detail below.

Figure 7:
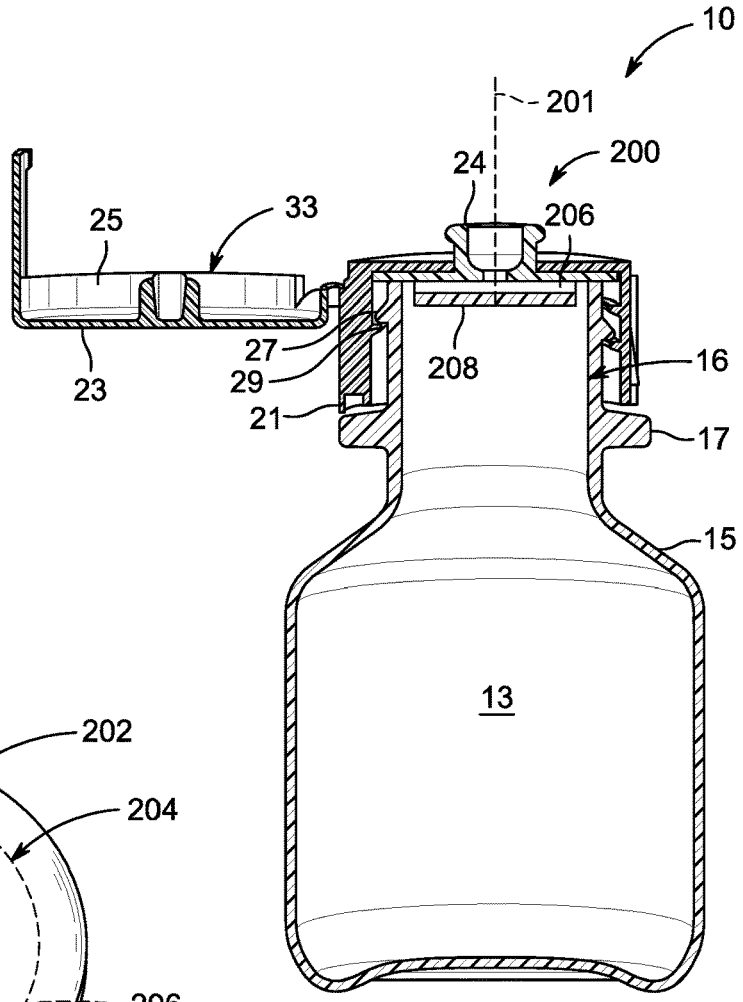
FIG. 7 is a sectional view of the package of FIG. 1, showing that the package further includes a first embodiment of a valve including a central port sized and arranged to extend through a central aperture formed in the lid.

The dosing dispenser 14 is configured to change from an opened position, as shown in FIG. 1, where the flip-top cap 22 is pivoted about a cap pivot axis 30 away from the lid 20, and a closed position, where the flip-top cap 22 is pivoted about the cap pivot axis 30 into engagement with the lid 20 to block access to the syringe receiver 24. The child-resistant closure-release mechanism 18 is configured to retain the flip-top cap 22 in the closed position to provide means for blocking unauthorized use of the package 10 while the flip-top cap 22 is in the closed position. The flip-top cap 22 may include a plug 33 that is inserted into the syringe receiver 24 in the closed position, as shown in FIG. 7.

Figure 2:
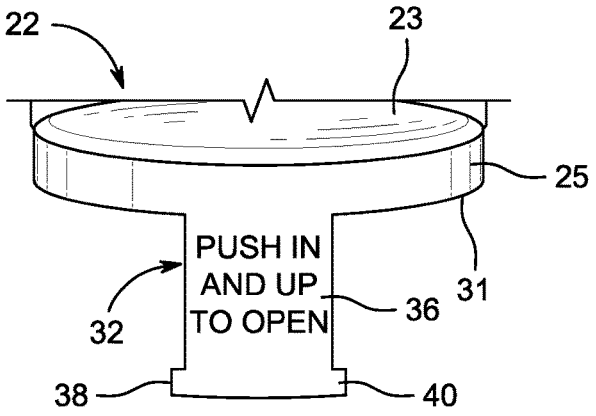
FIG. 2 is a front elevation view of the flip-top cap included in the dosing dispenser of FIG. 1, showing the lock tab including a flange and two protuberances extending therefrom.
Figure 3:
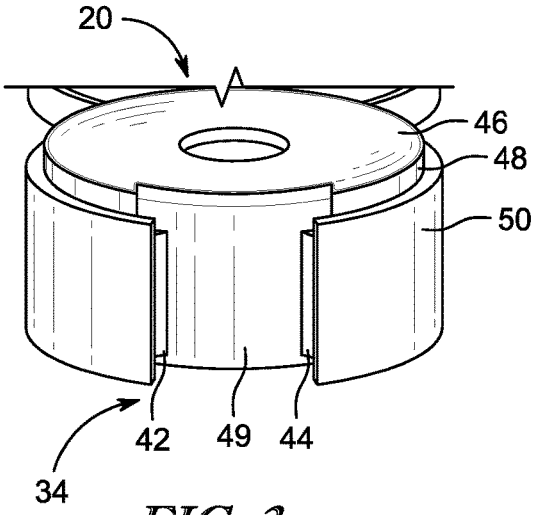
FIG. 3 is a front elevation view of a lid included in the dosing dispenser of FIG. 1, showing the lid including a top wall, a first side wall, a second side wall radially spaced apart from the first side wall, and a tab retainer having a pair of rails.

The child resistant lock 18 includes a lock tab 32 coupled to the flip-top cap 22 and a tab retainer 34 coupled to the lid 20 as shown in FIGS. 2 and 3. The lock tab 32 includes a plate 36, a first protuberance 38, and a second protuberance 40. The first and second protuberances 38, 40 extend outwardly away from the plate 36 in opposite directions. The tab retainer 34 includes a first rail 42 and a second rail 44 that are configured to engage selectively with the first and second protuberances 38, 40, respectively, to restrict movement of the dosing dispenser 14 from the closed position to the opened position. The first and second protuberances 38, 40 extend outwardly slightly less than a distance which two ends 64, 66 of the second end wall 50 of the lid 20 extends, which will be described in detail below.

The container 12 is generally cylindrically shaped and includes a transition portion 15 that tapers from an outer circumferential surface of the container to the filler neck 16 as shown in FIG. 1. The filler neck 16 is also generally cylindrically shaped and includes an outer rib 17 that surrounds an outer circumferential surface of the filler neck 16. The outer rib 17 is arranged such that a top surface of the rib 17 is annularly aligned with a bottom rim 21 of the lid 20 of the dosing dispenser 14 when the lid 20 is coupled to the filler neck 16. In other embodiments, the container 12 and filler neck 16 may be shaped differently, so long as the lid 20 is capable of being coupled to the top portion of the filler neck 16.

The lid 20 is coupled to the filler neck 16 of the container 12 via a threaded arrangement. In particular, the filler neck 16 includes at least one first thread 27 that extends around the circumference of the filler neck 16, and the lid 20 includes at least one second thread 29 that corresponds to the at least one first thread 27 such that the lid 20 may be screwed onto the filler neck 16. The lid 20 may be screwed onto the filler neck 16 until the bottom rim 21 of the lid 20 touches, or nearly touches, the outer rib 17 of the filler neck 16. In other embodiments, the lid 20 may be coupled to the filler neck 16 using other methods, such as press fitting or adhesives, for example.

Figure 6:
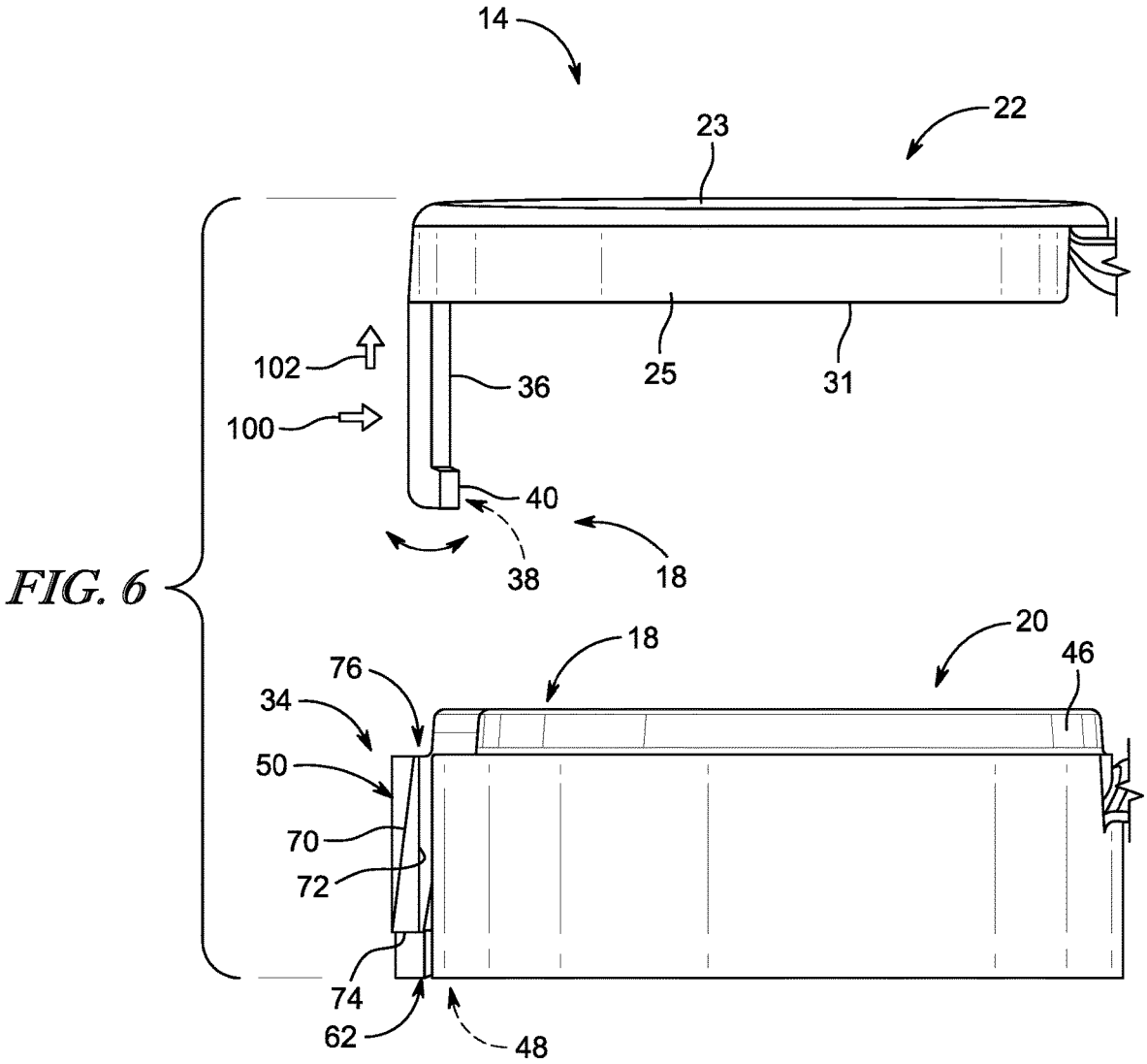
FIG. 6 is an exploded view of the flip-top cap and the lid of the dosing dispenser of FIG. 1, showing the protuberances of the lock tab aligning with the pair of rails of the tab retainer, and showing that, when the flip-top cap is in a closed position in which the protuberances are secured under the bottom surfaces of the rails, a user may apply an inward force to the lock tab to cause the lock tab to flex inward, and then may apply an upward force to cause the protuberances slide upwardly through the gap so that the flip-top cap may be opened.

The flip-top cap 22 is generally annular and hollow and includes a top surface 23 and an annular wall 25 that extends axially away from the top surface 23 as shown in FIGS. 1, 2, and 6. The annular wall 25 extends around the circumference of the top surface 23. The annular wall 25 may include a gap located near the pivot point 35 where the flip-top cap 22 and the lid 20 meet so as to allow the flip-top cap 22 to pivot about the cap pivot axis 30 and assume the closed position.

The lock tab 32 extends axially away from a portion of the annular wall 25 that is opposite the pivot point 35 where the flip-top cap 22 and the lid 20 meet. The lock tab 32 may be formed integrally with the annular rim 25, or may be formed as a separate component that is subsequently joined to the annular rim 25. Likewise, the first protuberance 38 and the second protuberance 40, which extend outwardly in the circumferential direction from the plate 36, may be integrally formed with the plate 36, or may be separate components that are subsequently joined. The lock tab 32 may include instruction text, such as the text "PUSH IN AND UP TO OPEN", as shown in FIG. 2, to inform a user how to open the flip-top cap 22. The lock tab 32 may also include a gripable surface to allow the user to effectively grip the lock tab 32, such as with his or her thumb, to push in and lift the lock tab 32 in order to move the lock tab 32 to the open position. The lock tab 32 may instead include ridges, ribs, or any other feature to provide a gripable surface.

Figure 4:
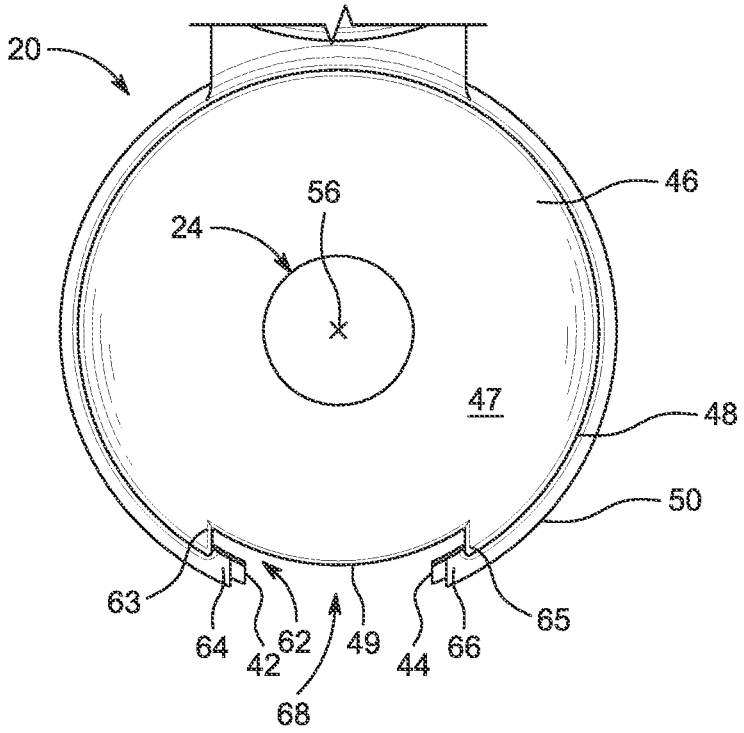
FIG. 4 is a top view of the lid of the dosing dispenser of FIG. 1, showing that the lid includes the top wall, the first side wall radially spaced apart from the second side wall, the tab retainer, and a central axis extending through an aperture in the top wall, showing that the second side wall includes a first end and a second end that are circumferentially spaced apart so as to provide a space between the first and second ends, and showing that the space generally corresponds to the lock tab in both width and location when the dosing dispenser is closed.

The lid 20 of the dosing dispenser 14 is also generally annular and hollow, so as to fit over the filler neck 16, and includes a top wall 46 having an upper surface 47, a first side wall 48, and a second side wall 50 as shown in FIGS. 2-7. The top wall 46 is formed to include an aperture 54 and has a central axis 56 that extends generally through the center of the top wall 46 through the aperture 54, as shown in FIG. 4. The first side wall 48 is generally cylindrical and extends annularly around the central axis 56. The first side wall 48 is concentric with the top wall 46 such that the top wall 46 encloses the first side wall 48.

The second side wall 50 extends annularly around the first side wall 48 and is concentric with the top wall 46 and the first side wall 48. The second side wall 50 is arranged or formed on the outer circumferential surface of the first side wall 48 as shown in FIG. 4. In some embodiments, the top wall 46, first side wall 48, and second side wall 50 may be integrally formed as a single monolithic piece. The top wall 46 and first and second side walls 48, 50 may also be formed as separate components that are subsequently joined together by known methods.

The second side wall 50 is sized to have a diameter substantially similar to a diameter of the annular wall 25 of the flip-top cap 22. The second side wall 50 is also substantially aligned with the outer rim 31 of the flip-top cap 22, and may extend radially the same distance as the outer rim 31. The second side wall 50 does not extend fully to the upper surface 47 of the top wall 46, but instead allows for a small portion of the first side wall 48 to be exposed above the second side wall 50. Accordingly, when the flip-top cap 22 is in the closed position, the outer rim 31 will align with the top surface of the second side wall 50 and seal the flip-top cap 22. However, in other embodiments, the diameter of the second side wall 50 may be smaller than the diameter of the annular wall 25 of the flip-top cap 22 such that, when the flip-top cap 22 is in the closed position, the annular wall 25 extends axially over at least a portion of the second side wall 50.

Figure 5:
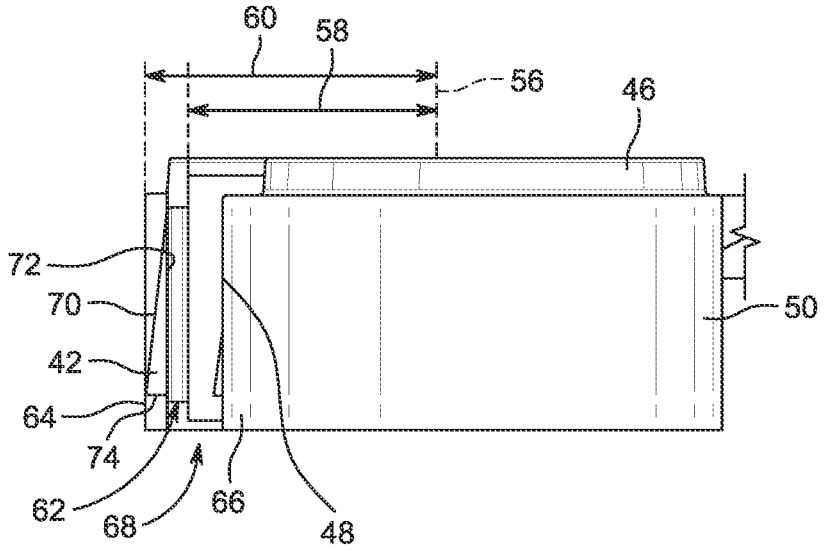
FIG. 5 is a side elevation view of the lid of the dosing dispenser of FIG. 1, showing that the lid includes the top wall, the first side wall radially spaced apart from the central axis a first distance and the second side wall radially spaced apart from the central axis a second distance, and the tab retainer, showing that the second side wall includes a first end and a second end that are circumferentially spaced apart so as to provide a space between the first and second ends, and showing that the rails each include a generally triangular shape in the circumferential direction and to provide an angled outer surface, an inner surface that converges with the outer surface at a point, and a bottom surface.

The first side wall 48 includes a recessed portion 49 that is spaced apart from the central axis 56 a first distance 58 as shown in FIG. 5. The second side wall 50 is spaced apart from the central axis 56 a second distance 60 that is greater than the first distance 58. The second side wall 50 includes a first end 64 and a second end 66 spaced apart from the first end 64 circumferentially around the central axis 56 to provide a space 68 between a first end 64 of the second end 66. The first and second ends 64, 66 extend beyond respective ends 63, 65 of the recessed portion 49 in the circumferential direction, as shown in FIG. 4. Accordingly, a gap 62 is formed radially between the recessed portion 49 of the first side wall 48 and the first and second ends 64, 66 of the second side wall 50.

The space 68 between the first and second ends 64, 66 of the second side wall 50 generally corresponds to the lock tab 32 in both width and location when the dosing dispenser 14 is in the closed position. The first and second rails 42, 44 are coupled to respective ends 64, 66 of the second side wall 50 and extend inwardly toward one another into the space 68.

Each rail 42, 44 has a generally triangular shape when viewed in the circumferential direction and includes an angled outer surface 70, an inner surface 72 and a bottom surface 74, as shown in FIGS. 5 and 6. The angled outer surface 70 and inner surface 72 converge at a point 76 near the top of the second side wall 50. The bottom surface 74 is spaced apart vertically from the point 76 and is generally perpendicular to the inner surface 72. The angled outer surface 70 moves further from the central axis 56 as the angled outer surface 70 extends from the point 76 to the bottom surface 74.

When a user desires to move the dosing dispenser 14 from the opened position to the closed position, the flip-top cap 22 may be moved about the cap pivot axis 30 toward lid 20. As the flip-top cap 22 moves toward the lid 20, the lock tab 32 moves into engagement with the angled outer surfaces 70 of the first and second rails 42, 44 at or near points 76. As the flip-top cap 22 is moved closer to the lid 20, the first and second protuberances 38, 40 slide along respective angled outer surfaces 70 and the lock tab 32 flexes outwardly away from the first side wall 48 due to the slope of the outer surfaces 70. Once the first and second protuberances 38, 40 pass the bottom surfaces 74 of the first and second rails 42, 44, the lock tab 32 returns to its unflexed position so that the first and second protuberances 38, 40 rest beneath the first and second rails 42, 44 and against the bottom surfaces 74 to establish the closed position.

The lock tab 32 may be made from polymeric materials, such as plastics, or any other flexible materials so as to allow the lock tab 32 to flex inwardly and outwardly relative to the flip-top cap 22, as suggested in FIG. 6. However, the material must be resilient enough such that when the first and second protuberances 38, 40 pass the bottom surfaces 74 of the first and second rails 42, 44, the lock tab 32 returns to its unflexed, original position.

When a user desires to move the flip-top cap 22 from the closed position to the opened position, the user may apply an inward force 100 on the lock tab 32 so that the lock tab 32 flexes inwardly toward the first side wall 48. Once the first and second protuberances 38, 40 pass a plane defined by the inner surfaces 72 of the first and second rails 42, 44 and are located within the gap 62, the user applies an upward force 102 to cause the first and second protuberances 38, 40 to slide upwardly through the gap 62. From there, the flip-top cap 22 may be moved unobstructed all the way to the opened position for access to the syringe receiver 24.

In other embodiments, each rail 42, 44 may be formed as a different shape, so long as the first and second protuberances 38, 40 of the lock tab 32 are capable of sliding outwardly and then locking in place under the first and second rails 42, 44. For example, the outer surfaces 70 of the first and second rails 42, 44 may have an arc shape such that the surfaces 70 are curved from the point 76 to the bottom surface 74. As such, the first and second protuberances 38, 40 may slide down along the curved outer surfaces 70 until they pass over and lock underneath the bottom surfaces 74.

In some embodiments, the first and second rails 42, 44 are sloped in the opposite direction, or in other words, sloped towards the first side wall 48. In this embodiment, when the lock tab 32 slides over the outer surfaces 70 of the rails 42, 44, the first and second protuberances 38, 40 slide along the outer surfaces 70 and the lock tab 32 flexes inwardly toward from the first side wall 48 due to the slope of the outer surfaces 70. Once the first and second protuberances 38, 40 pass the bottom surfaces 74 of the first and second rails 42, 44, the lock tab 32 returns to its unflexed position so that the first and second protuberances 38, 40 rest beneath the first and second rails 42, 44 and against the bottom surfaces 74 to establish the closed position.

When a user desires to move the flip-top cap 22 from the closed position to the opened position in this embodiment, the user may pull on the lock tab 32 in order to apply a force opposite of the inward force 100 shown in FIG. 6. In this case, the lock tab 32 flexes outwardly away from the first side wall 48. Once the first and second protuberances 38, 40 pass a plane defined by the inner surfaces 72 of the first and second rails 42, 44, the user applies an upward force 102 to cause the first and second protuberances 38, 40 to slide upwardly. From there, the flip-top cap 22 may be moved unobstructed all the way to the opened position for access to the syringe receiver 24.

The package 10 may further include a valve assembly 200, 300 configured to retain product in an internal region 13 of the container 12 when a syringe is not drawing the product out of the internal region 13 as shown in FIGS. 7-15. While valve assembly 200, 300 is illustratively made from a thermoplastic elastomeric material (TPE), any other suitable elastomers or plastics materials may be used in accordance with the present disclosure.

Figure 8:
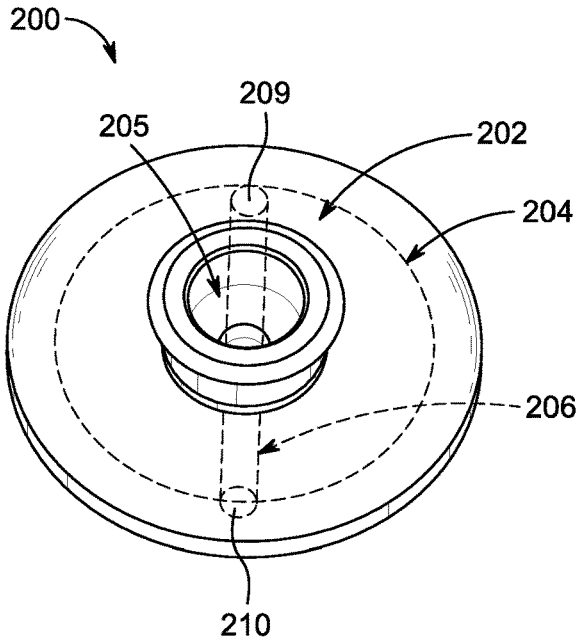
FIG. 8 is a perspective view of the valve assembly of FIG. 7, showing that the valve assembly includes an upper disk coupled to the central port and arranged against an inner surface of the top wall and a lower disk coupled to a lower surface of the upper disk, and showing that the central port and the upper disk are formed to include a first passageway that extends along the central axis and the lower disk is formed to include a second passageway that extends along a second axis that is transverse to the central axis.
Figure 9:
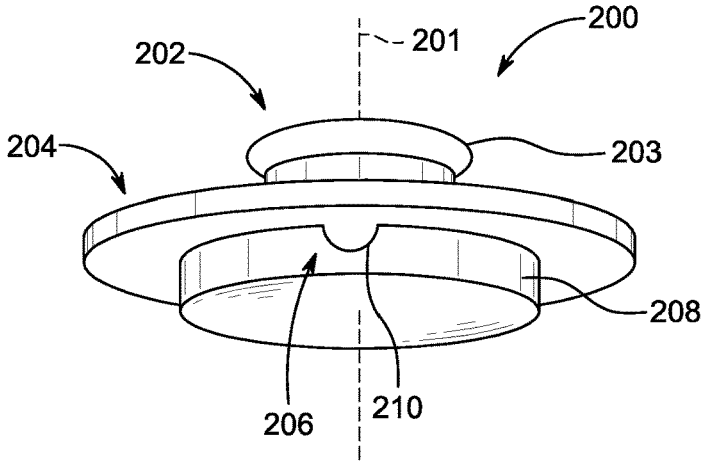
FIG. 9 is a perspective view of the valve assembly of FIG. 7, showing the central port, the upper disk, the lower disk, and the second passageway formed in the lower disk.

A first embodiment of a valve assembly 200 is shown in FIGS. 7-9. The valve assembly 200 includes an inlet port 202 and an upper disk 204 formed as a valve ring. The inlet port 202 provides the syringe receiver 24 and is formed to include a vertical passageway 205 that defines a central axis 201 that is aligned with the central axis 56 of the aperture 54. The inlet port 202 may include an upper ring 203 that extends annular around the top of the inlet port 202. The vertical passageway 205 opens selectively toward the internal region 13 of the container 12. The upper disk 204 is coupled to the top of the filler neck 16 in a manner known in the art. The lid 20 is placed over the upper disk 204 of the valve assembly 200 when the lid 20 is coupled to the filler neck 16, as shown in FIG. 7.

The valve assembly 200 further includes a lower disk 208 that is arranged on the underside of the upper disk 204 and is substantially concentric with the upper disk 204. As can be seen in FIG. 7, the lower disk 208 is located within the internal region 13. The lower disk 208 is formed to include a laterally extending passageway 206 that is coupled in fluid communication with the vertical passageway 205 formed in the inlet port 202. The laterally extending passageway 206 also includes two exit holes 209, 210 that are in fluid communication with the interior 13 of the container 12. The exit holes 209, 210 are sized as a function of the viscosity of the fluid in the bottle so as to block flow through the exit holes 209, 210 absent a suction force, such as from a fluid-transfer tip of a syringe. The exit holes 209, 210 may be formed as semi-circles, as shown in FIG. 9.

The vertical passageway 205 runs substantially transverse to the laterally extending passageway 206 as shown in FIG. 8. In some embodiments, the vertical passageway 205 is perpendicular to the laterally extending passageway 206. The passageways 205, 206 are sized to be substantially similar to the size of the exit holes 209, 210. Accordingly, the lengthened path and/or multiple narrow flow channels of the passageways 205, 206, along with the exit holes 209, 210, limit access to fluid in the container 12, as well as minimizing leakage when the package 10 is disturbed, such as being shaken or turned upside down.

Figure 10:
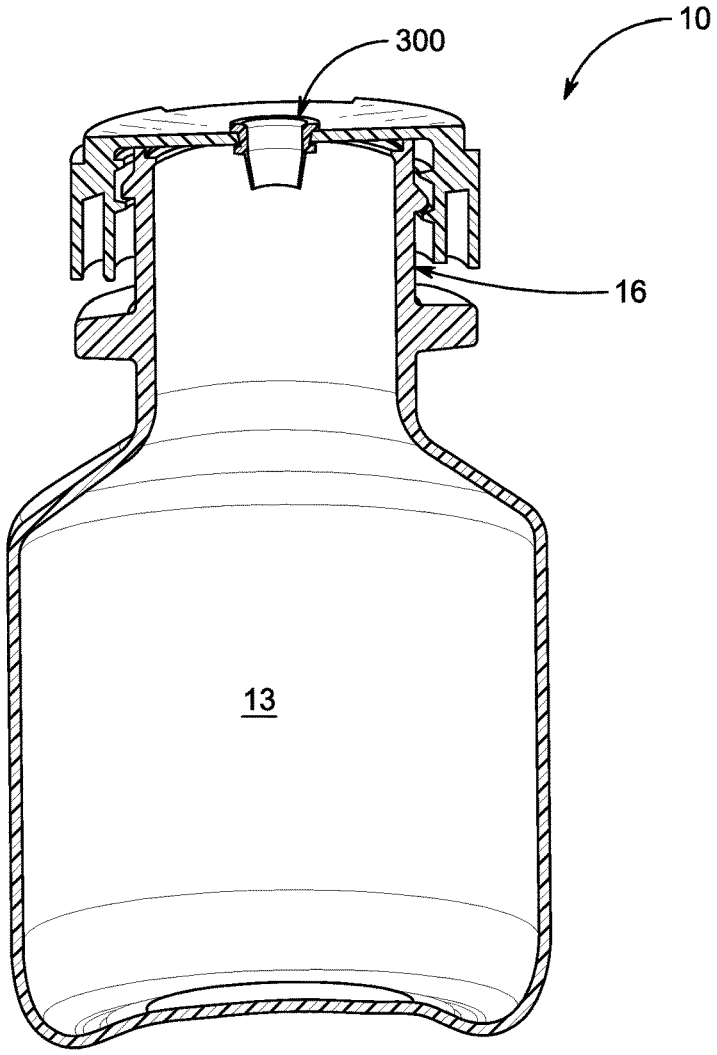
FIG. 10 is a sectional view of the package of FIG. 1, showing that the package includes a second embodiment of a valve assembly including a body formed to have a passageway that opens into an internal region of the container, an outer rib, and an inner rib.
Figure 11:
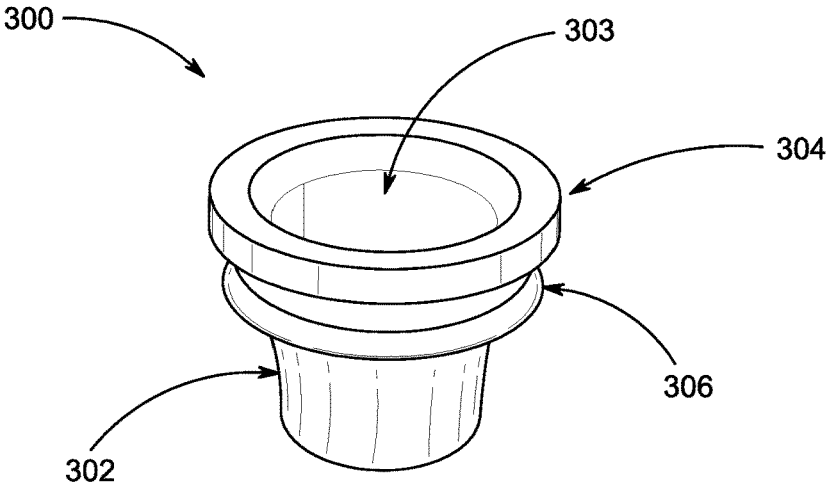
FIG. 11 is a perspective view of the valve assembly of FIG. 10 showing the body, the passageway, the outer rib, and the inner rib.
Figure 12:
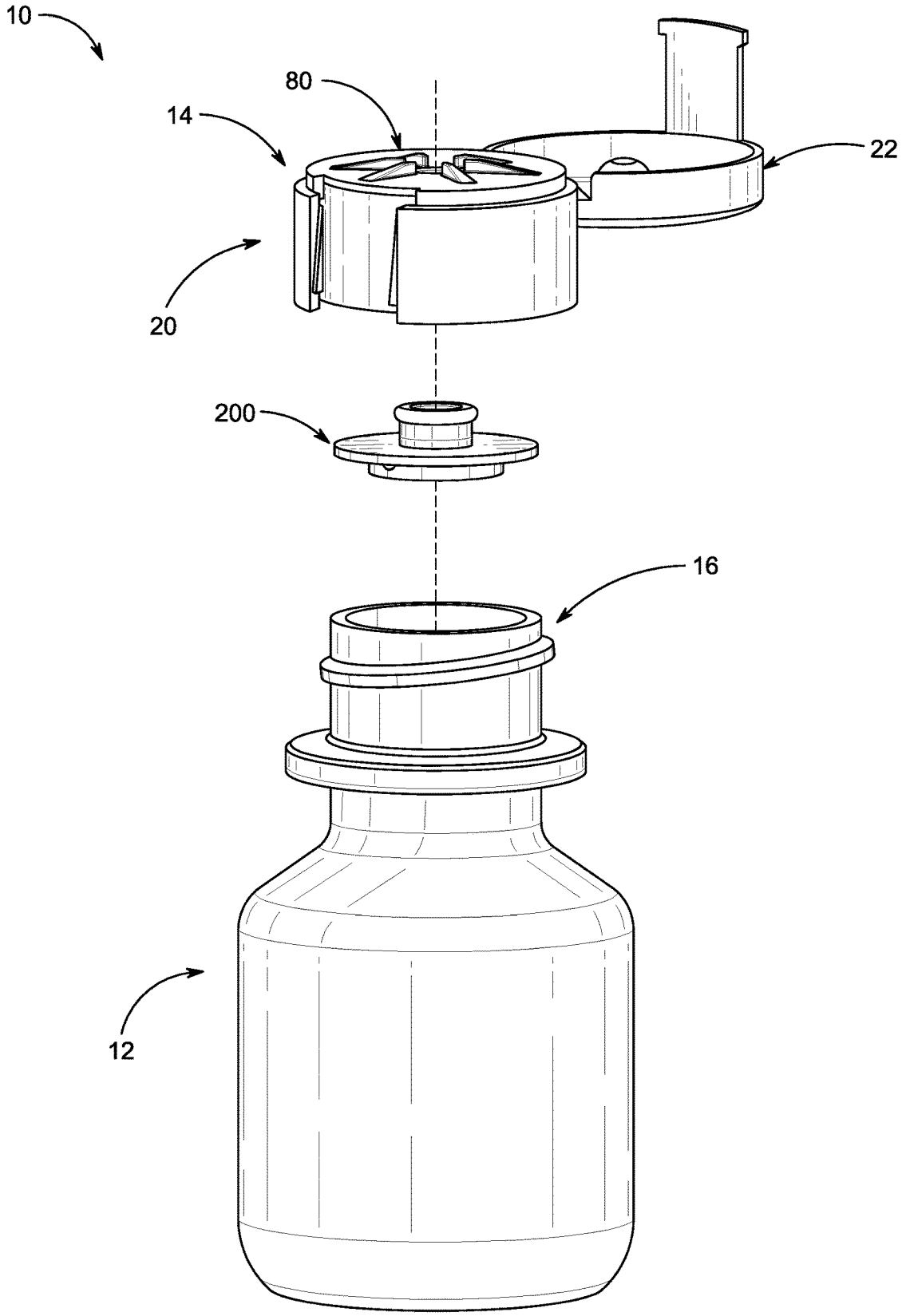
FIG. 12 is an exploded view of the package including the valve assembly of FIGS. 7-9 showing that the package further includes an anti-suction feature coupled to the top wall of the lid and configured to maintain spacing between an upper surface of the top wall and a mouth of a person placed on the lid around the opening to minimizes formation of a complete seal between the mouth and the lid so that the person cannot establish sufficient suction to remove fluid through the opening.

A second embodiment of a valve assembly 300 is shown in FIGS. 10 and 11. The valve assembly 300 includes a body 302, an annular outer rib 304, and an annular inner rib 306. The body 302 provides the syringe receiver 24 and is formed to include a passageway 303 that opens selectively into the internal region 13 of the container 12. In particular, the passageway 303 may be formed as a one-way passageway 303 so as to block flow of fluid through the passageway 303 absent a fluid-transfer tip of a syringe. In some embodiments, the valve assembly 300 may be a duck-bill valve.

As can be seen in FIG. 10, the outer rib 304 and the inner rib 306 are axially spaced apart substantially the same distance as the width of the top wall 46 of the lid 20. Accordingly, the valve assembly 300 may be fitted into the aperture 54 in the top wall 46 so as to locate the body 302 in the aperture 54. Similarly to the valve assembly 200 described above, the valve assembly 300 limits access to fluid in the container 12, as well as preventing leakage even when the package 10 is disturbed, such as being shaken or turned upside down.

The package 10 further includes an anti-suction feature 80 arranged on the top wall 46 of the lid 20 as shown in FIGS. 12-15. The anti-suction feature 80 may be used with either valve assembly 200, as suggested in FIGS. 12 and 13, valve assembly 300, as suggested in FIGS. 14 and 15, or another suitable valve assembly. The dosing dispenser 14, the valve 200, 300, and the container 12 of the package 10 are arranged in the same manner as shown in FIGS. 1-11, as discussed above. The anti-suction feature 80 is configured to block a user, such as a child, from establishing a seal with the top wall 46 over the syringe receiver 24 and providing a sufficient suction force that would remove the fluid from the container 12 through the valve assemblies 200, 300.

Figure 13:
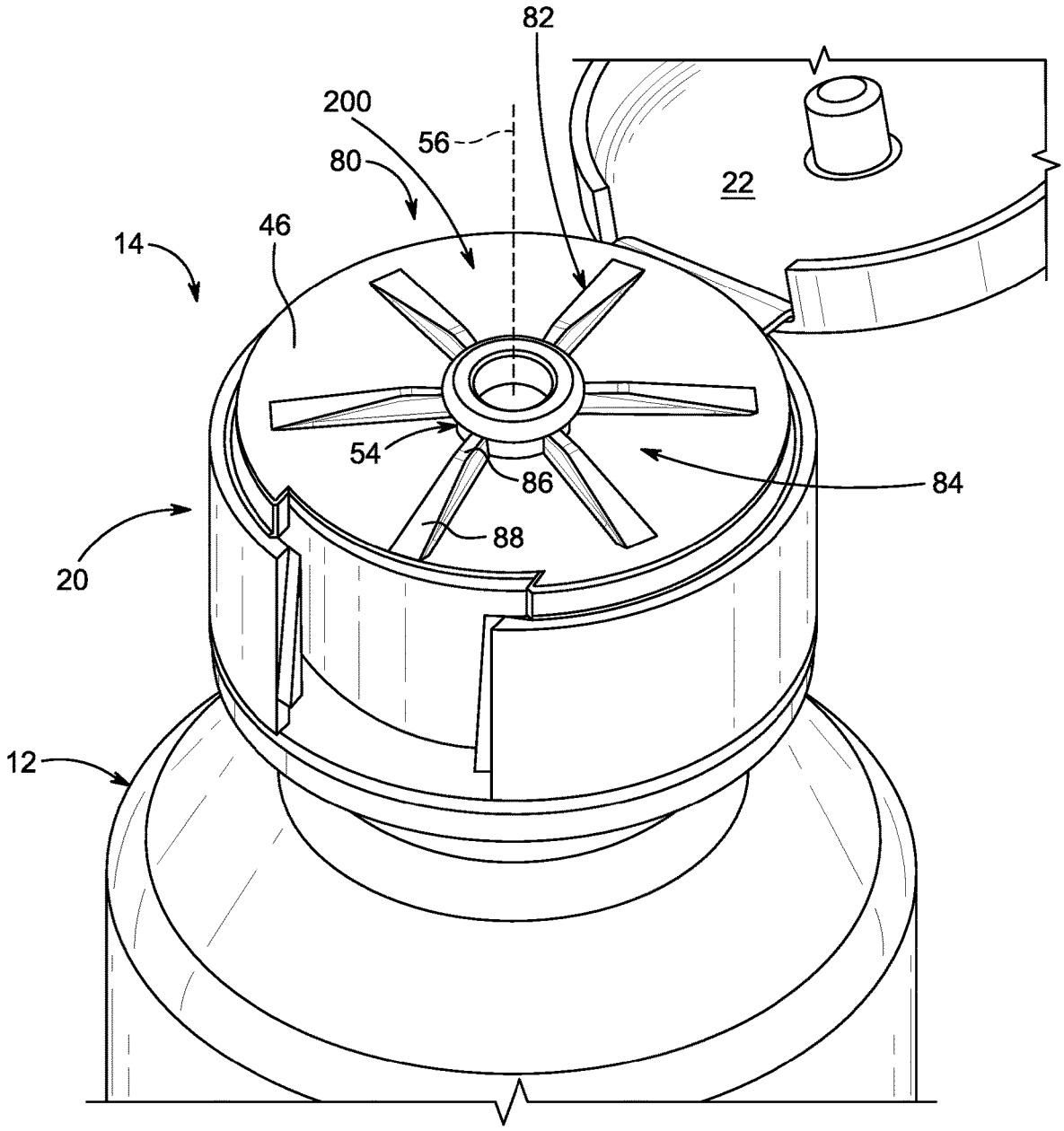
FIG. 13 is an enlarged perspective view of the package of FIG. 12 showing the anti-suction feature coupled to the top wall of the lid, showing that the anti-suction feature includes a plurality of ribs coupled to the upper surface of the top wall and that extend outwardly away from the opening along the upper surface, and showing that each of the ribs included in the plurality of ribs includes an inner portion that abuts the opening and an outer portion that extends outwardly away from the inner portion.
Figure 14:
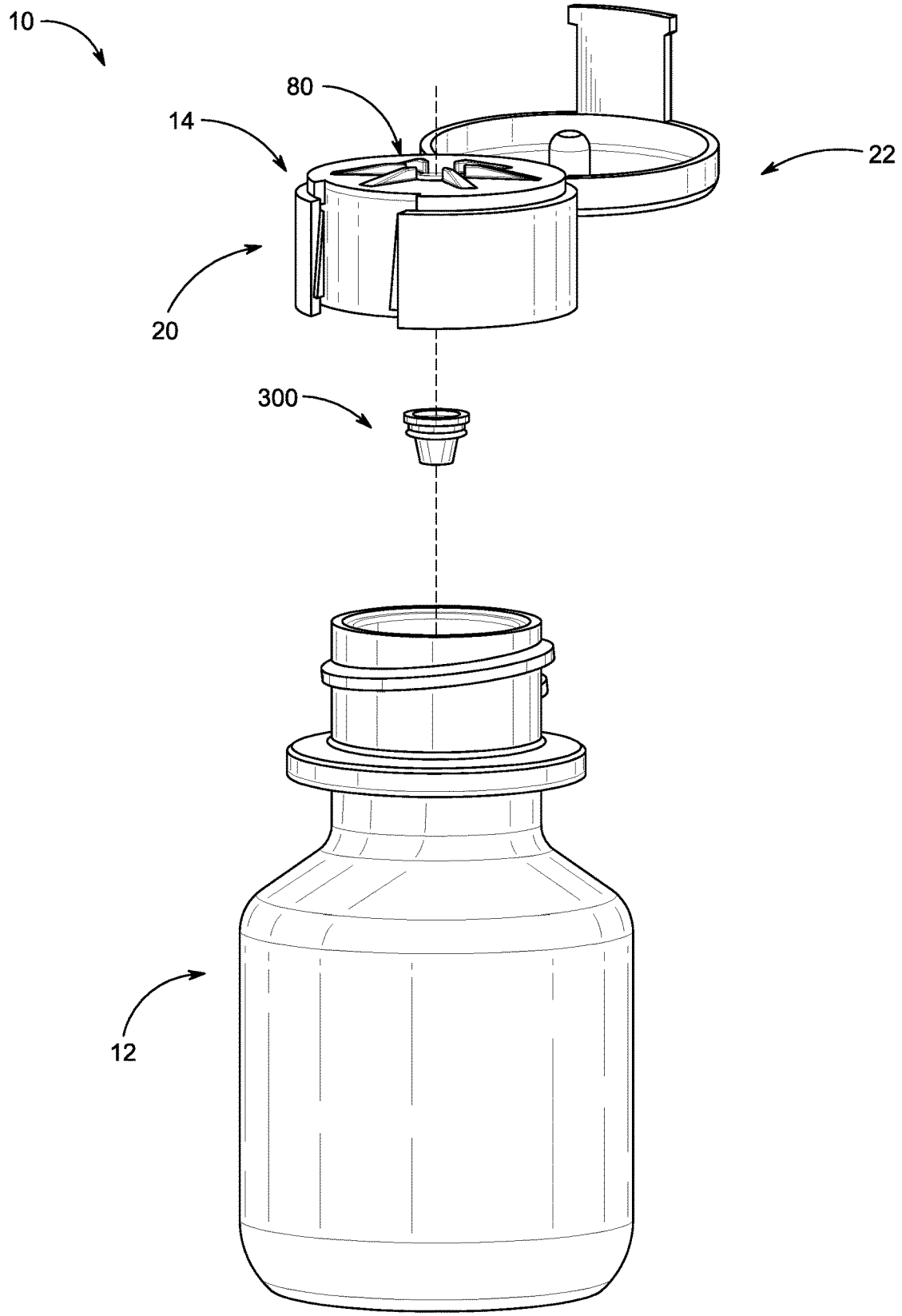
FIG. 14 is an exploded view of the package including the valve assembly of FIGS. 10 and 11 showing that the package further includes an anti-suction feature coupled to the top wall of the lid and configured to maintain spacing between an upper surface of the top wall and a mouth of a person placed on the lid around the opening to prevent a complete seal from forming between the mouth and the lid so that the person cannot establish sufficient suction to remove fluid through the opening.
Figure 15:
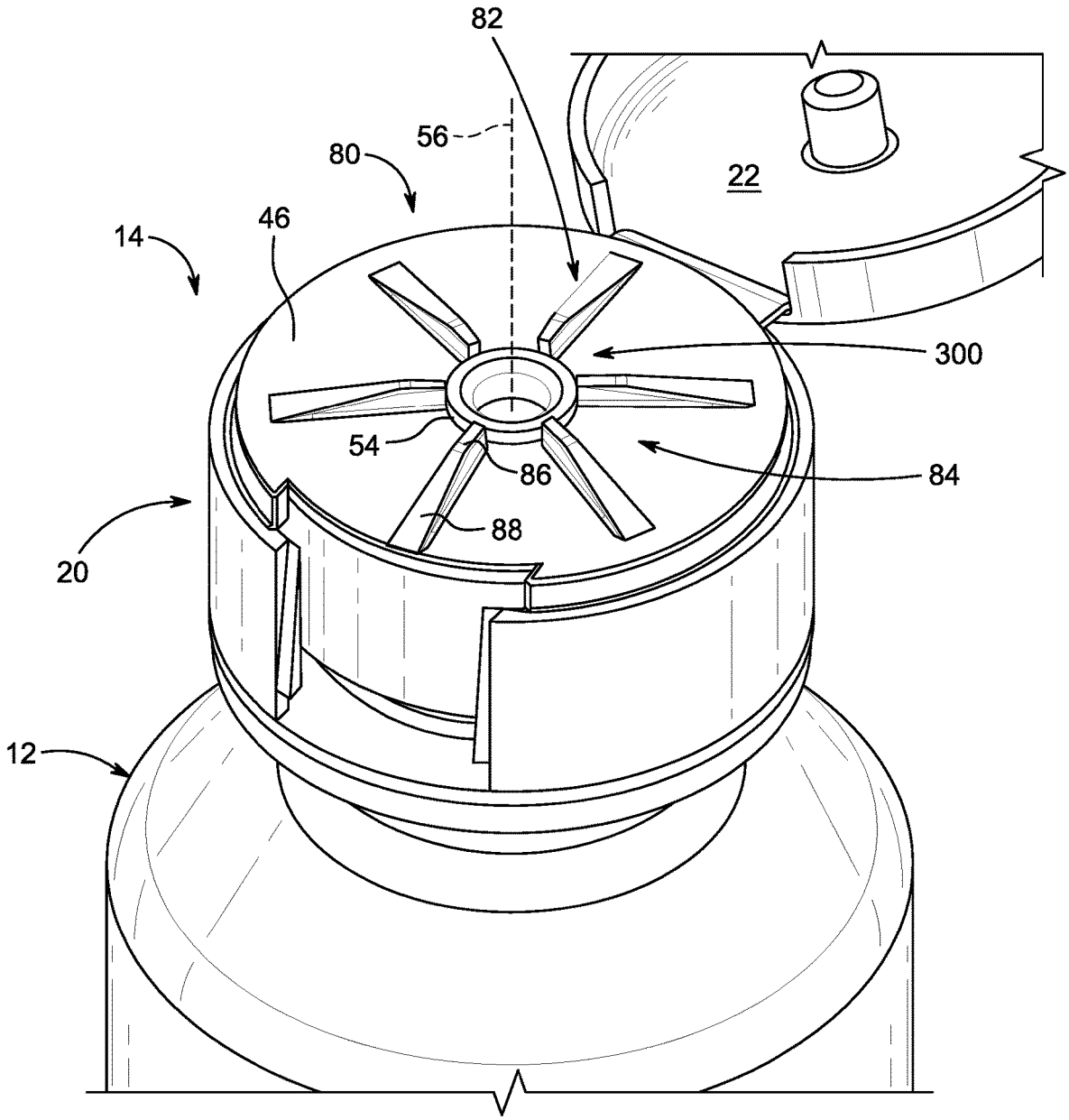
FIG. 15 is an enlarged perspective view of the package of FIG. 14 showing the anti-suction feature coupled to a top wall of the dosing dispenser, showing that the anti-suction feature includes a plurality of ribs coupled to the upper surface of the top wall and that extend outwardly away from the opening along the upper surface, and showing that each of the ribs included in the plurality of ribs includes an inner portion that abuts the opening and an outer portion that extends outwardly away from the inner portion.

The anti-suction feature 80 includes a plurality of ribs 82 spaced circumferentially around the central axis 56 and extending radially away from the central axis 56 as shown in FIGS. 13 and 15. The plurality of ribs 82 may extend to the outer circumferential edge of the top wall 46, or may terminate just before the outer edge, as shown in FIGS. 13 and 15. In the illustrative embodiment, six ribs 82 are included in the anti-suction feature 80, however, in other embodiments, any suitable number of ribs may be used. The plurality of ribs 82 may be identically shaped, as shown in FIGS. 13 and 15, or may have differing shapes while still providing the gaps 84 discussed below. In the illustrative embodiment, each of the ribs 82 is spaced apart circumferentially from one another an equal distance, however, in other embodiments, any suitable spacing may be used. In yet another embodiment, the plurality of ribs 82 may be spaced circumferentially from one another by unequal distances.

Each of the ribs 82 includes an inner portion 86 that abuts the aperture 54 formed in the top wall 46 and a portion of the valve assemblies 200, 300, and an outer portion 88 radially outward from the inner portion 86, as shown in FIGS. 13 and 15. The inner portion 86 has a height from the top wall 46 that is greater than a height of the outer portion 88. The outer portion 88 tapers downwardly toward the top wall 46 as the ribs 82 extend radially outward from the aperture 54. In the illustrative embodiment, the outer portion 88 has a width that increases as the ribs 82 extend radially outward from the aperture 54. Although the ribs 82 are generally triangularly shaped, the transition from the inner portion 86 to the outer portion 88 may be stepped, curved, or any other suitable shape that will allow for air to pass through the gaps 84, as discussed in detail below.

The plurality of ribs 82 extend vertically away from the top wall 46 as shown in FIGS. 13 and 15. In the embodiment that includes the valve assembly 200, as shown in FIG. 13, each inner portion 86 of the plurality of ribs 82 extends upwardly to an underside of the upper ring 203 of the valve assembly 200. In the embodiment that includes the valve assembly 300, as shown in FIG. 15, each inner portion 86 of the plurality of ribs 82 extend upwardly beyond a top surface of the outer rib 304 of the valve assembly 300.

In the illustrative embodiment, the spacing between each of the ribs 82 provides gaps 84. If a user attempts to place his or her mouth over the lid 20, and subsequently attempts to provide a suction force to remove fluid from the container 12, the gaps 84 allow air to flow therethrough because at least a portion of the user's mouth is spaced apart from the top wall 46 by the inner portions 86 of the plurality of ribs 82. In this way, the plurality of ribs 82 minimize formation of a complete seal between the user's mouth and the top wall 46 of the lid 20 over the syringe receiver 24. The plurality of ribs 82 thus provide additional safety features to the dosing dispenser 14 to minimize unwanted removal of fluid from the container 12.

The following numbered clauses include embodiments that are contemplated and non-limiting:

Clause 1. A closure comprising a lid including a top wall formed to include a central opening, and a side wall that extends downwardly from the top wall.

Clause 2. The closure of clause 1, any other clause, or combination of clauses, wherein the side wall has an inner side wall that extends circumferentially about a central axis, an outer side wall spaced radially from the inner side wall and that extends only part-way around the central axis, and a rim connector that interconnects the inner side wall with the outer side wall.

Clause 3. The closure of clause 2, any other clause, or combination of clauses, further comprising a flip-top cap mounted to the lid for pivotable movement about a cap pivot axis between a closed position, in which the flip-top cap covers the central opening formed in the lid, and an opened position, in which the flip-top cap is spaced apart from the top wall of the lid to expose the central opening.

Clause 4. The closure of clause 3, any other clause, or combination of clauses, further comprising a child-resistant closure-release mechanism including a lock tab coupled to the flip-top cap to move therewith and first and second retainer rails coupled to the outer side wall of the lid in a fixed position relative to the flip-top cap.

Clause 5. The closure of clause 4, any other clause, or combination of clauses, wherein the lock tab is deformable relative to the lid from a locked position, in which the lock tab engages the first and second retainer rails to block the flip-top cap from pivoting about the cap pivot axis to the opened position, and an unlocked position, in which at least a portion of the lock tab is deformed inwardly toward the inner side wall of the lid to disengage the lock tab from the first and second retainer rails so that the lock tab is movable with the flip-top cap between the inner and outer side walls of the lid as the flip-top cap is pivoted about the cap pivot axis from the closed position to the opened position.

Clause 6. The closure of clause 5, any other clause, or combination of clauses, wherein the lock tab includes a body plate that is coupled to the flip-top cap, a first protuberance coupled to a first circumferential side of the body plate, and a second protuberance coupled to a second circumferential side of the body plate.

Clause 7. The closure of clause 6, any other clause, or combination of clauses, wherein the first protuberance is arranged to engage the first retainer rail in the locked position and the second protuberance is arranged to engage the second retainer rail in the locked position.

Clause 8. The closure of clause 7, any other clause, or combination of clauses, wherein the first and second retainer rails each include a slopped outer surface that engages a corresponding one of the first and second protuberances as the flip top cap is pivoted from the opened position toward the closed position and a lower retainer surface that engages the corresponding one of the first and second protuberances when the lock tab is in the locked position.

Clause 9. The closure of clause 8, any other clause, or combination of clauses, wherein the first and second retainer rails each further include an inner surface spaced apart from the inner side wall to provide first and second unlocking passageways therebetween that receive the corresponding one of the first and second protuberances after the lock tab is deformed and as the flip-top cap is moved from the closed position toward the opened position.

Clause 10. The closure of clause 5, any other clause, or combination of clauses, further comprising a valve including a central port sized and arranged to extend through the central aperture formed in the top wall, an upper disk coupled to the central port and arranged against an inner surface of the top wall, and a lower disk coupled to a lower surface of the upper disk.

Clause 11. The closure of clause 10, any other clause, or combination of clauses, wherein the central port and the upper disk are formed to include a first passageway that extends along the central axis and the lower disk is formed to include a second passageway that extends along a second axis that is transverse to the central axis.

Clause 12. The closure of clause 11, any other clause, or combination of clauses, wherein the upper disk has an outer diameter that is sized to locate an outer edge of the upper disk between the top wall of the lid and an upper surface of a filler neck of a container.

Clause 13. The closure of clause 12, any other clause, or combination of clauses, wherein the lower disk has an outer diameter that is less than the outer diameter of the upper disk and to locate an outer edge of the lower disk in spaced-apart relation to the filler neck of the container.

Clause 14. The closure of clause 5, any other clause, or combination of clauses, further comprising an anti-suction feature coupled to the top wall of the lid and configured to maintain spacing between an upper surface of the top wall and a mouth of a person placed on the lid around the opening to minimize formation of a complete seal between the mouth and the lid so that the mount cannot establish sufficient suction to remove fluid through the opening.

Clause 15. The closure of clause 14, any other clause, or combination of clauses, wherein the anti-suction feature includes a plurality of ribs coupled to the upper surface of the top wall and that extend outwardly away from the opening along the upper surface.

Clause 16. A closure comprising a lid including a top wall formed to include a central opening, and a side wall that extends downwardly from the top wall.

Clause 17. The closure of clause 16, any other clause, or combination of clauses, wherein the side wall has an inner side wall that extends circumferentially about a central axis, an outer side wall spaced radially from the inner side wall and that extends only part-way around the central axis, and a rim connector that interconnects the inner side wall with the outer side wall.

Clause 18. The closure of clause 17, any other clause, or combination of clauses, further comprising a flip-top cap mounted to the lid for pivotable movement about a cap pivot axis between a closed position, in which the flip-top cap covers the central opening formed in the lid, and an opened position, in which the flip-top cap is spaced apart from the top wall of the lid to expose the central opening.

Clause 19. The closure of clause 18, any other clause, or combination of clauses, further comprising a valve including a central port sized and arranged to extend through the central aperture formed in the top wall, an upper disk coupled to the central port and arranged against an inner surface of the top wall, and a lower disk coupled to a lower surface of the upper disk.

Clause 20. The closure of clause 19, any other clause, or combination of clauses, wherein the central port and the upper disk are formed to include a first passageway that extends along the central axis and the lower disk is formed to include a second passageway that extends along a second axis that is transverse to the central axis.

Clause 21. The closure of clause 20, any other clause, or combination of clauses, wherein the second axis is perpendicular to the central axis.

Clause 22. The closure of clause 21, any other clause, or combination of clauses, wherein the second passageway extends between a first aperture and a second aperture and the first and second apertures are sized to block fluid flow through the second passageway in the absence of a vacuum force above a predetermined threshold.

Clause 23. The closure of claim 22, any other clause, or combination of clauses, wherein the upper disk has an outer diameter that is sized to locate an outer edge of the upper disk between the top wall of the lid and an upper surface of a filler neck of a container.

Clause 24. The closure of claim 23, any other clause, or combination of clauses, wherein the lower disk has an outer diameter that is less than the outer diameter of the upper disk to locate an outer edge of the lower disk in spaced-apart relation to the filler neck of the container.

Clause 25. The closure of clause 20, any other clause, or combination of clauses, further comprising an anti-suction feature coupled to the top wall of the lid and configured to maintain spacing between an upper surface of the top wall and a mouth of a person placed on the lid around the opening to minimize formation of a complete seal between the mouth and the lid so that the mount cannot establish sufficient suction to remove fluid through the opening.

Clause 26. The closure of clause 25, any other clause, or combination of clauses, wherein the anti-suction feature includes a plurality of ribs coupled to the upper surface of the top wall and that extend outwardly away from the opening along the upper surface.

Clause 27. A closure comprising a lid including a top wall formed to include an opening and a side wall that extends downwardly from the top wall and extends circumferentially about a central axis.

Clause 28. The closure of clause 27, any other clause, or combination of clauses, further comprising a flip-top cap mounted to the lid for pivotable movement about a cap pivot axis relative to the lid between a closed position and an opened position.

Clause 29. The closure of clause 28, any other clause, or combination of clauses, further comprising an anti-suction feature coupled to the top wall of the lid and configured to maintain spacing between an upper surface of the top wall and a mouth of a person placed on the lid around the opening to minimize formation of a complete seal between the mouth and the lid so that the person cannot establish sufficient suction to remove fluid through the opening.

Clause 30. The closure of clause 29, any other clause, or combination of clauses, wherein the anti-suction feature includes a plurality of ribs coupled to the upper surface of the top wall and that extend outwardly away from the opening along the upper surface.

Clause 31. The closure of clause 30, any other clause, or combination of clauses, wherein each of the ribs included in the plurality of ribs includes an inner portion that abuts the opening and an outer portion that extends outwardly away from the inner portion.

Clause 32. The closure of clause 31, any other clause, or combination of clauses, wherein the inner portion has a greater height from the upper surface of the top wall compared to the outer portion.

Clause 33. The closure of clause 32, any other clause, or combination of clauses, wherein the outer portion tapers as it extends outwardly such that a height of the outer portion from the upper surface of the top wall decreases.

Clause 34. The closure of clause 30, any other clause, or combination of clauses, wherein a width of each rib increases as each rib extends outwardly from the opening.

Clause 35. The closure of clause 29, any other clause, or combination of clauses, further comprising a valve including a central port sized and arranged to extend through the central opening formed in the top wall, an upper disk coupled to the central port and arranged against an inner surface of the top wall, and a lower disk coupled to a lower surface of the upper disk.

Clause 36. The closure of clause 35, any other clause, or combination of clauses, wherein the central port and the upper disk are formed to include a first passageway that extends along the central axis and the lower disk is formed to include a second passageway that extends along a second axis that is transverse to the central reference axis.

Clause 37. The closure of clause 36, any other clause, or combination of clauses, further comprising a child-resistant closure-release mechanism including a lock tab coupled to the flip-top cap and first and second retainer rails coupled to the outer side wall of the lid.

Clause 38. The closure of clause 37, any other clause, or combination of clauses, wherein the lock tab is deformable relative to the lid from a locked position, in which the lock tab engages the first and second retainer rails to block the flip-top cap from pivoting about the cap pivot axis to the opened position, and an unlocked position, in which at least a portion of the lock tab is deformed inwardly toward the inner side wall of the lid to disengage the lock tab from the first and second retainer rails so that the lock tab is movable with the flip-top cap between the inner and outer side walls of the lid as the flip-top cap is pivoted about the cap pivot axis from the closed position to the opened position.

The invention claimed is:

1. A closure comprising a lid including a top wall formed to include a central opening, and a side wall that extends downwardly from the top wall, the side wall having an inner side wall that extends circumferentially about a central axis, an outer side wall spaced radially from the inner side wall and arranged to extend only part-way around the central axis, and a rim connector that interconnects the inner side wall with the outer side wall, a flip-top cap mounted to the lid for pivotable movement about a cap pivot axis between a closed position, in which the flip-top cap covers the central opening, and an opened position, in which the flip-top cap is spaced apart from the top wall of the lid to expose the central opening, a child-resistant closure-release mechanism including a lock tab coupled to the flip-top cap to move therewith and first and second retainer rails coupled to the outer side wall of the lid in a fixed position relative to the flip-top cap, and a valve including a central port sized and arranged to extend through the central aperture formed in the top wall, an upper disk coupled to the central port and arranged against an inner surface of the top wall, and a lower disk coupled to a lower surface of the upper disk, wherein the lock tab is deformable relative to the lid from a locked position, in which the lock tab engages the first and second retainer rails to block the flip-top cap from pivoting about the cap pivot axis to the opened position, and an unlocked position, in which at least a portion of the lock tab is deformed inwardly toward the inner side wall of the lid to disengage the lock tab from the first and second retainer rails so that the lock tab is movable with the flip-top cap between the inner and outer side walls of the lid as the flip-top cap is pivoted about the cap pivot axis from the closed position to the opened position.

2. The closure of claim 1, wherein the lock tab includes a body plate that is coupled to the flip-top cap, a first protuberance coupled to a first circumferential side of the body plate, and a second protuberance coupled to a second circumferential side of the body plate, the first protuberance arranged to engage the first retainer rail in the locked position and the second protuberance arranged to engage the second retainer rail in the locked position.

3. The closure of claim 2, wherein the first and second retainer rails each include a sloped outer surface that engages a corresponding one of the first and second protuberances as the flip top cap is pivoted from the opened position toward the closed position and a lower retainer surface that engages the corresponding one of the first and second protuberances when the lock tab is in the locked position.

4. The closure of claim 3, wherein the first and second retainer rails each further include an inner surface spaced apart from the inner side wall to provide first and second unlocking passageways therebetween that receive the corresponding one of the first and second protuberances after the lock tab is deformed and as the flip-top cap is moved from the closed position toward the opened position.

5. The closure of claim 1, wherein the central port and the upper disk are formed to include a first passageway that extends along the central axis and the lower disk is formed to include a second passageway that extends along a second axis that is transverse to the central axis.

6. The closure of claim 5, wherein the upper disk has an outer diameter that is sized to locate an outer edge of the upper disk between the top wall of the lid and an upper surface of a filler neck of a container, and the lower disk has an outer diameter that is less than the outer diameter of the upper disk and to locate an outer edge of the lower disk in spaced-apart relation to the filler neck of the container.

7. The closure of claim 1, further comprising an anti-suction feature coupled to the top wall of the lid and configured to maintain spacing between an upper surface of the top wall and a mouth of a person placed on the lid around the opening to minimize formation of a complete seal between the mouth and the lid so that the mount cannot establish sufficient suction to remove fluid through the opening, wherein the anti-suction feature includes a plurality of ribs coupled to the upper surface of the top wall and that extend outwardly away from the opening along the upper surface.

8. A closure comprising a lid including a top wall formed to include a central opening, and a side wall that extends downwardly from the top wall, the side wall having an inner side wall that extends circumferentially about a central axis, an outer side wall spaced radially from the inner side wall and that extends only part-way around the central axis, and a rim connector that interconnects the inner side wall with the outer side wall, a flip-top cap mounted to the lid for pivotable movement about a cap pivot axis between a closed position, in which the flip-top cap covers the central opening formed in the lid, and an opened position, in which the flip-top cap is spaced apart from the top wall of the lid to expose the central opening, and a valve including a central port sized and arranged to extend through the central aperture formed in the top wall, an upper disk coupled to the central port and arranged against an inner surface of the top wall, and a lower disk coupled to a lower surface of the upper disk, wherein the central port and the upper disk are formed to include a first passageway that extends along the central axis and the lower disk is formed to include a second passageway that extends along a second axis that is transverse to the central axis.

9. The closure of claim 8, wherein the second axis is perpendicular to the central axis.

10. The closure of claim 9, wherein the second passageway extends between a first aperture and a second aperture and the first and second apertures are sized to block fluid flow through the second passageway in the absence of a vacuum force above a predetermined threshold.

11. The closure of claim 8, wherein the upper disk has an outer diameter that is sized to locate an outer edge of the upper disk between the top wall of the lid and an upper surface of a filler neck of a container, and the lower disk has an outer diameter that is less than the outer diameter of the upper disk to locate an outer edge of the lower disk in spaced-apart relation to the filler neck of the container.

12. The closure of claim 8, further comprising an anti-suction feature coupled to the top wall of the lid and configured to maintain spacing between an upper surface of the top wall and a mouth of a person placed on the lid around the opening to minimize formation of a complete seal between the mouth and the lid so that the mount cannot establish sufficient suction to remove fluid through the opening, wherein the anti-suction feature includes a plurality of ribs coupled to the upper surface of the top wall and that extend outwardly away from the opening along the upper surface.

13. A closure comprising a lid including a top wall formed to include an opening and a side wall that extends downwardly from the top wall and extends circumferentially about a central axis, a flip-top cap mounted to the lid for pivotable movement about a cap pivot axis relative to the lid between a closed position and an opened position, and an anti-suction feature coupled to the top wall of the lid and configured to maintain spacing between an upper surface of the top wall and a mouth of a person placed on the lid around the opening to minimize formation of a complete seal between the mouth and the lid so that the person cannot establish sufficient suction to remove fluid through the opening.

14. The closure of claim 13, wherein the anti-suction feature includes a plurality of ribs coupled to the upper surface of the top wall and that extend outwardly away from the opening along the upper surface, and each of the ribs included in the plurality of ribs includes an inner portion that abuts the opening and an outer portion that extends outwardly away from the inner portion.

15. The closure of claim 14, wherein the inner portion has a greater height from the upper surface of the top wall compared to the outer portion.

16. The closure of claim 15, wherein the outer portion tapers as it extends outwardly such that a height of the outer portion from the upper surface of the top wall decreases and a width of each rib increases as each rib extends outwardly from the opening.

17. The closure of claim 14, further comprising a valve including a central port sized and arranged to extend through the central opening formed in the top wall, an upper disk coupled to the central port and arranged against an inner surface of the top wall, and a lower disk coupled to a lower surface of the upper disk, the central port and the upper disk being formed to include a first passageway that extends along the central axis and the lower disk being formed to include a second passageway that extends along a second axis that is transverse to the central reference axis.

18. The closure of claim 13, further comprising a child-resistant closure-release mechanism including a lock tab coupled to the flip-top cap and first and second retainer rails coupled to the outer side wall of the lid.

19. The closure of claim 18, wherein the lock tab is deformable relative to the lid from a locked position, in which the lock tab engages the first and second retainer rails to block the flip-top cap from pivoting about the cap pivot axis to the opened position, and an unlocked position, in which at least a portion of the lock tab is deformed inwardly toward the inner side wall of the lid to disengage the lock tab from the first and second retainer rails so that the lock tab is movable with the flip-top cap between the inner and outer side walls of the lid as the flip-top cap is pivoted about the cap pivot axis from the closed position to the opened position.

* * * * *